US006989787B2

(12) United States Patent
Park et al.

(10) Patent No.: US 6,989,787 B2
(45) Date of Patent: Jan. 24, 2006

(54) ANTENNA SYSTEM FOR SATELLITE COMMUNICATION AND METHOD FOR TRACKING SATELLITE SIGNAL USING THE SAME

(75) Inventors: Ung-Hee Park, Daejon (KR); Soon-Ik Jeon, Daejon (KR); Seong-Ho Son, Busan (KR); Jae-Seung Yun, Daejon (KR)

(73) Assignee: Electronics and Telecommunications Research Institute (KR)

( * ) Notice: Subject to any disclaimer, the term of this patent is extended or adjusted under 35 U.S.C. 154(b) by 0 days.

(21) Appl. No.: 10/744,210

(22) Filed: Dec. 22, 2003

(65) Prior Publication Data

US 2005/0093743 A1 May 5, 2005

(30) Foreign Application Priority Data

Oct. 30, 2003 (KR) ..... 10-2003-0076352

(51) Int. Cl.
*H01Q 3/00* (2006.01)

(52) U.S. Cl. ..... 342/359

(58) Field of Classification Search ..... 342/359; 455/69; 343/763, 766

See application file for complete search history.

(56) References Cited

U.S. PATENT DOCUMENTS 3,568,197 A * 3/1971 Cubley ..... 342/354
5,245,348 A * 9/1993 Nishikawa et al. ..... 342/359
5,561,434 A * 10/1996 Yamazaki ..... 342/372
6,028,552 A * 2/2000 Shuguang ..... 342/372
6,034,634 A * 3/2000 Karlsson et al. ..... 342/359
6,184,825 B1 * 2/2001 Wehner et al. ..... 342/359
6,191,734 B1 * 2/2001 Park et al. ..... 342/359
6,496,146 B1 12/2002 Chang et al.
6,657,589 B2 * 12/2003 Wang et al. ..... 342/383
6,825,807 B1 * 11/2004 McKinnon ..... 342/359
2002/0057225 A1 * 5/2002 Spirtus ..... 343/766
2003/0090416 A1 * 5/2003 Howell et al. ..... 342/359

FOREIGN PATENT DOCUMENTS

KR 2002-56920 10/2002

OTHER PUBLICATIONS

Development for the Tracking Antenna System in Ship's DBS Receiver, Jo–Cheun Choi et al., (Paper for memorial of Information and Communication Day, Apr. 1997, p. 494–504).

Theoretical Analysis for Beam Pointing Accuracy of Stair–Planar Phased Array Antenna with Tracking Beam, Seong Ho Son et al., IEEE Antennas and Propagation Society International Symposium, vol. 4, 2003 Digest, Jun. 22–27, 2003, pp. 204–207.

* cited by examiner

*Primary Examiner*—Thomas H. Tarcza
*Assistant Examiner*—F H Mull
(74) *Attorney, Agent, or Firm*—Blakely, Sokoloff, Taylor & Zafman

(57) ABSTRACT

Provided is an antenna system for satellite communication and a method for tracking satellite signals using the same, in which moving vehicles or vessels can perform a satellite multimedia communication. The method for tracking a satellite signal using the antenna system includes the steps of: a) setting a satellite signal reception environment by performing an electronic tracking in the elevation direction through an electronic beam steering control and performing a mechanical tracking for driving a rotating element in an azimuth direction; and b) stopping a drive of the rotating element in the azimuth direction, and setting a satellite signal transmission environment by using the satellite signal reception environment. According to the present invention, since both one-dimensional phase array control of the elevation and azimuth and one-dimensional mechanical control are used, it is possible to provide the economical and effective system compared with two-dimensional phase array antenna.

10 Claims, 17 Drawing Sheets

ANTENNA SYSTEM FOR SATELLITE COMMUNICATION AND METHOD FOR TRACKING SATELLITE SIGNAL USING THE SAME

FIELD OF THE INVENTION

The present invention relates to an antenna system for satellite communication and a method for tracking satellite signals using the same; and, more particularly, to an antenna system for satellite communication and a method for tracking satellite signals using the same, in which moving vehicles or vessels can perform a satellite multimedia communication.

DESCRIPTION OF THE PRIOR ART

A conventional bi-directional satellite communication has widely used a low-capacitance voice signal communication using a low earth orbit-satellite (LEO-satellite) based on a concept of mobile phone, and a satellite multimedia communication using a fixed antenna system based on a concept of very small aperture terminal (VSAT).

In the bi-directional communication using a satellite, a mobile communication terminal system requires an antenna having a satellite tracking function in order to maintain a stable communication environment.

FIG. 1 shows a basic configuration of a conventional phased array antenna.

As shown, n number of unit radiating elements 110 receives satellite signals having an initial directional phase value. A satellite signal receiver 120 determines reception strengths of the satellite signals and transfers the reception signal strength information to a satellite tracking processor 140. The information is inputted to a tracking processing program block 150 that performs a satellite searching function, a control selecting function, an on-turning control function, an on-nonturning control function and an on-blocking control function.

The tracking processing programs block 150 judges situations and calculates an accurate satellite direction to transfer a beam direction control signal in order to enable the unit radiating elements to be directed in a desired direction. In this case, in order to determine the satellite tracking direction and speed, the tracking processing programs block 150 also processes the rotational angular velocity information outputted from an angular velocity sensor 130.

FIG. 2 is an exemplary diagram showing a single beamforming of the phased array antenna. In FIG. 2, a reception satellite signal is incident and a single beam of an antenna is formed at a desired antenna directional angle θ°.

If phase delay values are supplied to each unit phase shifter B1 to Bn by using the beam directional control signal of FIG. 2, each unit radiating element A1 to An is delayed by a phase difference ΔΦ so that satellite signals can arrive in the same phase at the same time.

In this case, the delay value is related to the distance difference "d" between the unit radiating elements. At the same time, the satellite signals received in the same phases through each unit radiating element are coupled at a signal power coupler to thereby be a final antenna reception satellite broadcasting signal 220 before it reaches the receiver.

FIG. 3 shows a configuration of a conventional mobile active antenna system for receiving a satellite signal. The system includes an antenna radome part 31 and an active antenna signal processing part 32.

The antenna radome part 31 includes the m number of active channel sub-modules 311 to 314 each being divided into four groups, four signal power couplers 315 to 318, a beamforming module 319, a rotary power 320, a tracking signal converter 321, a beam steering controller 322, a rotary platform 330, a rotary jointer 323, a frequency converter 324, and a drive controller 328. The active antenna signal processing part 32 includes a satellite tracking processor 327, an electronic direction detector 326, and a power module 325.

If the satellite signal reaches the antenna radome part 31, the m active channel sub-modules are coupled into four groups by m/4 using the signal power coupler. A detailed structure of the active channel sub-module is shown in FIG. 4.

The four signals coupled using the signal power coupler are transferred to the beamforming module 319. FIG. 5 shows a detailed structure of the beamforming module of FIG. 3.

As shown, the four reception satellite signals transferred to the beamforming module are distributed. The signals are formed as a secondary beam through a low noise amplifier, a phase shifter, a power control and first reception signal power coupler and then outputted to the tracking signal converter 321. Additionally, the distributed signals of the opposite side are signal-power-coupled by a second reception signal coupler and transferred to the rotary jointer 323. Then, the signals are converted into an intermediate frequency by the frequency converter 324. The intermediated frequency is filtered through a band pass filter and outputted to the satellite broadcasting receiver 34.

The tracking signal converter 321 receives the satellite signal in a form of the secondary beam, detects the strength of the satellite tracking information signal, and transfers the detected information to the beam steering controller 322. The beam steering of the secondary beam can provide the signal of the current steering direction and the up/down and right/left satellite signal of the steering direction as the information of the tracking signal converter at regular time intervals by using the phase shifter of the beamforming module.

In case the successive current steering directions are not optimal to the satellite, the provided value can find the satellite.

The beam steering controller 322 transfers the information on characteristics of the current steering beam and adjacent beam to the satellite tracking processor 327 of the active antenna signal processing part 32 through the rotary jointer 323. The program loaded on the satellite tracking processor 327 calculates the information together with the information processed result with respect to the moving object's motion that is detected through the electronic direction detector 326, and outputs the azimuth and elevation information of the satellite position and the tracking speed information.

The azimuth and speed information is outputted to the drive controller 328, so that a direction drive motor 329 is controlled and supervised to perform a one-dimensional azimuth control that is suitable for the corresponding information. The elevation information is also outputted to the beam steering controller 322, and the beam steering controller 322 performs an operation for the beamforming in order to control a desired one-dimensional elevation control and calculates a phase delay value code of a required double beam, which is assigned to each phase shifter. The assigned phase delay value code is transmitted to the active channel sub-module and the beamforming module 319 in order for the one-dimensional elevation control, the beamforming and the beam steering.

A power supply 33 supplies a power to the power module 325 of the active antenna signal processing part 32 and the power module 325 supplies the power necessary to the respective elements. One of them is supplied to the rotary power 320 through the rotary jointer 323 and the rotary power 320 supplies the power to all portions of the rotary platform 330.

The drive motor 329 moves the rotary platform 330 to control the azimuth of the active antenna in the one dimension. The m active channel sub-modules divided into the four groups, the four signal power couplers, the beamforming module, the tracking signal converter, the beam steering controller and the rotary power are loaded on the rotary platform 330.

In a relative rotation state of a fixed portion of the antenna radome part 31 and a rotating portion disposed above the rotary platform 330, the rotary jointer 323 performs the functions of transmitting the satellite reception signal and the respective control signal and successively supplying the power without opening.

On the measurement request, the electronic direction detector 326 provides 3-axis position information including an absolute direction, a front inclination and a side inclination of the moving object.

A conventional method widely used for the satellite tracking is to use an antenna having a fixed directional angle and control the antenna on 2-dimension mechanically. However, the conventional method has a problem in that the tracking speed and position control is complex.

Further, in the case of a method for controlling a phase of the unit antenna element on 2-dimension by using the phased array antenna, there occurs a problem in that a control is complex due to a large number of elements to be phase-controlled and a manufacturing cost increases.

SUMMARY OF THE INVENTION

It is, therefore, an object of the present invention to provide an antenna system for satellite communication and a method for tracking a satellite signal using the antenna system, which is capable of increasing a tracking accuracy and reducing a tracking loss, in which both one-dimensional phase array control of the elevation is mixed with one-dimensional mechanical control of azimuth and a double beam satellite tracking method and an electronic direction detecting method are used.

In accordance with one aspect of the present invention, there is provided an antenna system for satellite communication including a transmission/reception connecting means for communication terminal and an information exchanging means in order for tracking an elevation electronically and tracking a satellite electronically/mechanically. The antenna system comprises: a plurality of array antennas for transmitting/receiving a signal to/from a satellite; a plurality of reception active channel modules for performing a low noise amplification to a predetermined frequency of a satellite signal inputted through the plurality of array antennas and for shifting the frequency to a desired phase; a reception active module for receiving the satellite signal from the plurality of reception active channel modules, coupling the satellite signals according to positions of the antenna arrays, and transmitting the coupled satellite signals to the communication terminal through the transmission/reception connecting means; a first conversion means for receiving the signals from the communication terminal and up-converting the signal into a satellite frequency; a transmission active module for amplifying/dividing the signals inputted from the first conversion means through the transmission/reception connecting means; a plurality of transmission active channel modules for controlling a phase of the signals inputted from the transmission active module and transmitting the phase-controlled signals to the array antenna; and a first control means for controlling the plurality of reception active channel modules, the reception active module, the plurality of transmission active channel modules and the transmission active module by using a satellite tracking signal inputted from the reception active module.

Further, the antenna system further comprises: a second control means for receiving an azimuth information of a current satellite from the first control means and generating a current according to the azimuth information; a drive means for receiving the current from the second control means and driving a rotating member of the antenna system; and a platform configured to rotate by a rotation driving force.

In accordance with another aspect of the present invention, there is provided a method for tracking a satellite signal using an antenna system for satellite communication, the antenna system tracking an elevation electronically and track a satellite electronically/mechanically, the method comprising the steps of: a) setting a satellite signal reception environment by performing an electronic tracking in the elevation direction through an electronic beam steering control and performing a mechanical tracking for driving a rotating element in an azimuth direction; and b) stopping a drive of the rotating element in the azimuth direction, and setting a satellite signal transmission environment by using the satellite signal reception environment.

Further, the method further comprises the step of c) breaking a transmission power if failing to catch the satellite signal, performing a mechanical tracking in an azimuth direction during a predetermined time, and performing an electronic tracking in an elevation direction.

The antenna system for satellite communication in accordance with the present invention receives the satellite signals through the reception terminal of the combined transmission/reception array antenna configured with a plurality of signal patch antennas. The reception active channel module controls the phase of the received satellite signals so that the low noise amplification and antenna array can have the desired phase, and then provided to the reception active module.

The reception active module divides and couples the signals supplied from the respective reception active channels into four sub-array groups, an array group of the boundary portion and the other group according to the positions of the antenna arrays.

The array group of the boundary portion divides the signals into the signals of the four sub-array group according to the positions. The powers of the four sub-array group are coupled through the respective phase shifter in order to track the satellite through the power divider, and then supplies the low frequency signal to the satellite tracking signal detector by using the down frequency converter. The supplied signals are used for checking the position of the satellite and controlling the phase state of the reception active channel module and the transmission active channel module.

Another signals provided through the power dividers of the four sub-array groups are coupled with the signals of the antenna arrays, which are not used to form the sub-array signals, and the coupled signals are passed through the down frequency converter, the transmission/reception duplexer and the rotary joint and slip ring, and then outputted to the communication terminal.

According to the present invention, in order to transmit the signals to the satellite, the transmission signals must be supplied from the communication terminal.

The transmission signals supplied from the communication terminal are converted into the transmission frequency of the moving object active antenna system by using the up converter. The transmission signals are provided to the transmission active module by using the transmission/reception duplexer and the rotary jointer and slip ring.

In case the communication environments of the antenna system for satellite communication and the connecting satellite are not achieved, the transmission active module blocks the transmission signals using the RF switch as a means for reducing damages on other satellites. The transmission active module has a function of amplifying the signals and supplying the signals to the transmission active channel module.

The respective transmission active channel module receiving the signals from the transmission active module transmits the signals to the transmission input terminal of the combined transmission/reception antenna array through the phase control of the phase controller in response to the phase control command provided from the beam control and satellite tracking controller.

The antenna system according to the present invention can be manufactured with a small space because the radiating elements of the antenna are used as the combined transmission and reception. Additionally, the transmission signals and the reception signals can simultaneously use one communication line through one slip ring by using the up frequency converter, the down frequency converter and two transmission/reception duplexers.

Further, as described above, in case of receiving the satellite signals, the signal coupling of the reception active module is different according to the positions of the antenna arrays. In case of transmitting the signals to the satellite, the transmission signals are blocked automatically if the communication environment between the system and the satellite are not formed.

Meanwhile, some of the reception signals are used as the satellite tracking signal. Based on the reception signals, the transmission frequency and the position of the satellite are calculated automatically and the phase of the transmission active channel module is controlled, thereby providing a stable communication environment.

In order to receive the satellite signals and maintain the optimum communication environment between the system and the satellite, the antenna system for mobile communication terminal employs an electronic satellite tracking at small angles in an elevation direction. For the azimuth direction, an electronic method is employed at small angles by using the rotary platform and the antenna array. A combined method using a mechanical method is employed at large angles.

Further, according to the antenna system of the present invention, in case the environment for the moving object has a smooth slope, the satellite tracking is possible within the satellite tracking range. In environment conditions, the antenna system can be used in vessels together with a vertical motion corrector.

Further, after the power on, the initialization process is carried out. Based on the satellite signals inputted from the combined transmission/reception antenna, the optimum satellite signal reception environment is set through the azimuth motor control and electronic beam steering control. Using the optimum satellite signal reception environment, the transmission environment for the satellite can be calculated and set automatically.

Further, in case the system fails to catch the position of the satellite signal due to an abrupt motion environment variation of the moving object, the transmission signals from the antenna are blocked and the fact is provided to the communication terminal. Then, the satellite signals are searched mechanically and electronically in the range of right/left azimuth angle and up/down elevation angle during a predetermined time, checking the communication environment. If the communication environment is not formed, the satellite signals are initialized mechanically and electronically in the full range of the azimuth angle and in some range of the elevation angle.

Furthermore, according to the method of the present invention, a control loop is formed in the satellite searching process in order to feed back the angular velocity of the moving object. In the autotracking process, it is possible to use a multi control loop configured with control loops that can feed back the information corresponding to the electronic beam steering angle of the azimuth direction.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE PREFERRED EMBODIMENTS

Hereinafter, a detailed description of the preferred embodiments will be made with reference the accompanying drawings.

Figure 1:
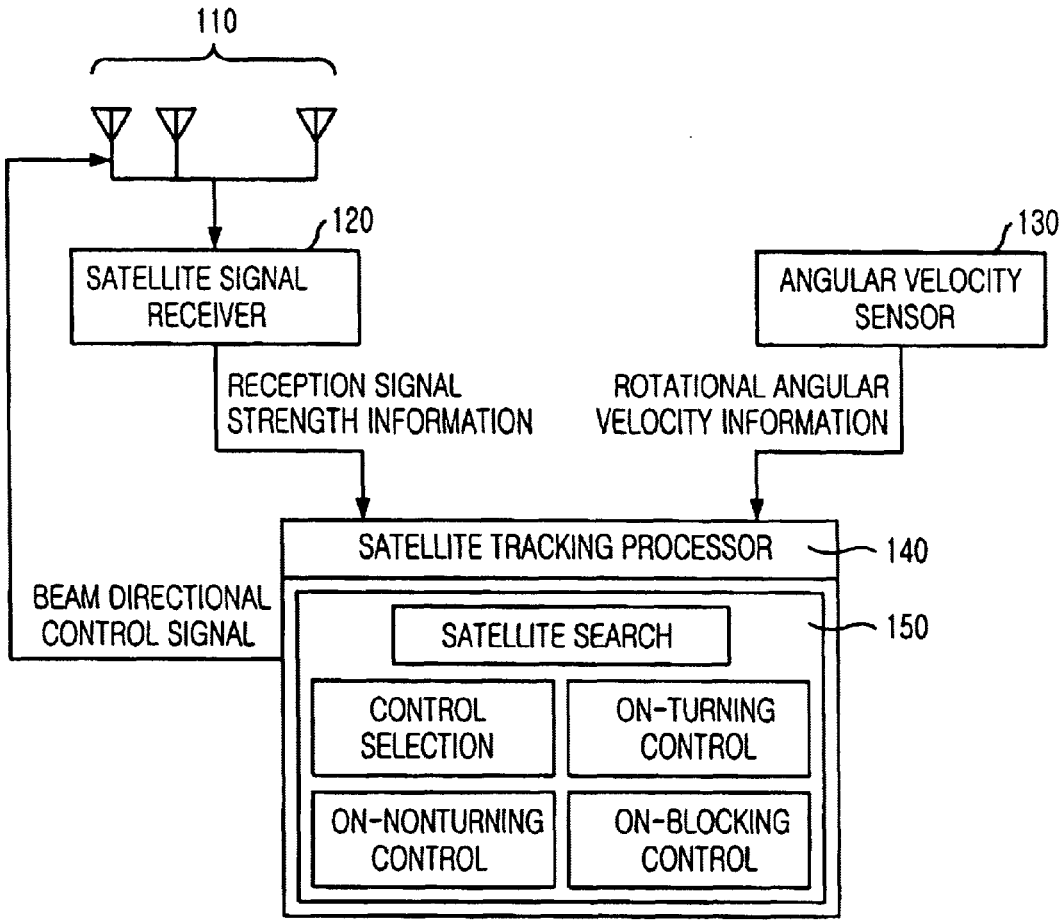
FIG. 1 (PRIOR ART)
FIG. 1 shows a basic configuration of a conventional phased array antenna.
Figure 2:
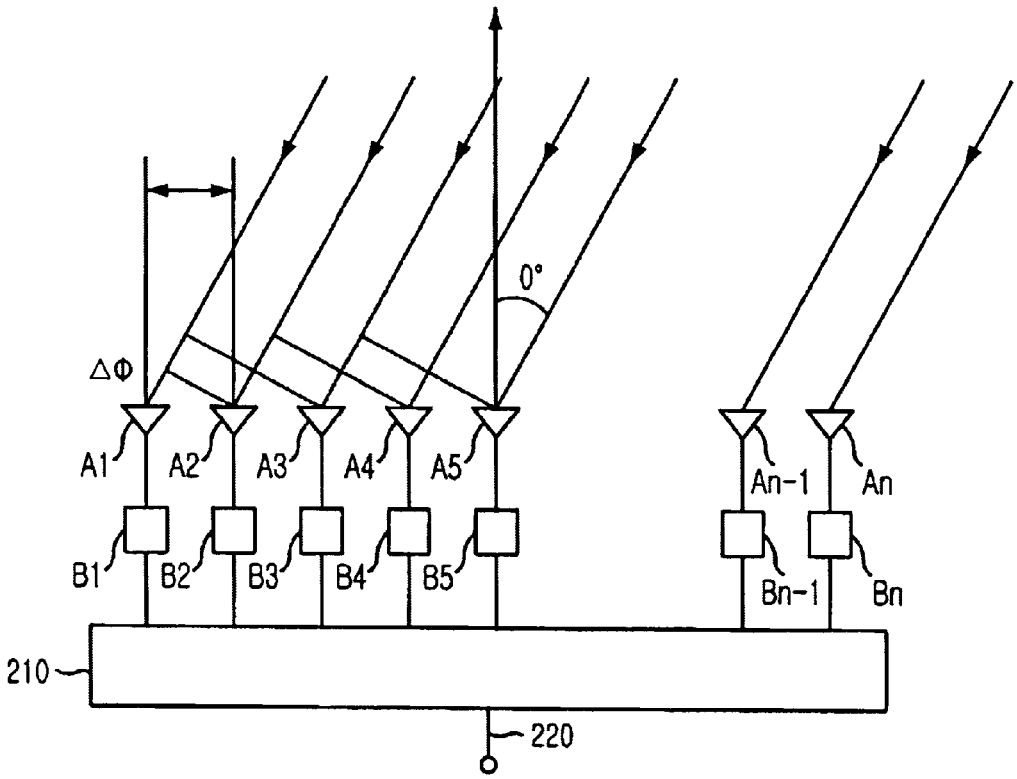
FIG. 2 (PRIOR ART)
FIG. 2 is an exemplary diagram of a single beamforming in a phased array antenna.
Figure 3:
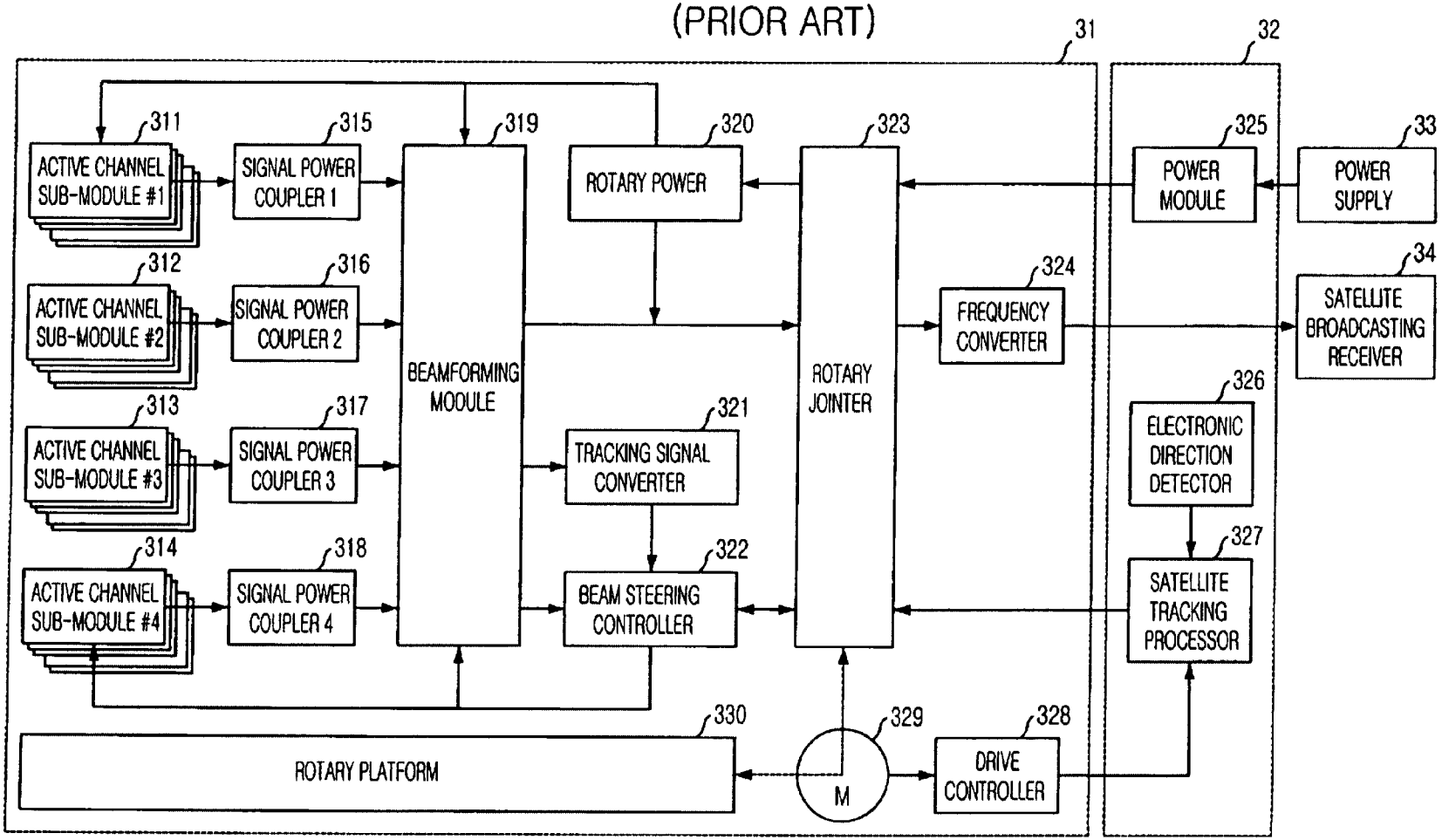
FIG. 3 (PRIOR ART)
FIG. 3 shows a configuration of a conventional mobile active antenna system for receiving a satellite signal.
Figure 4:
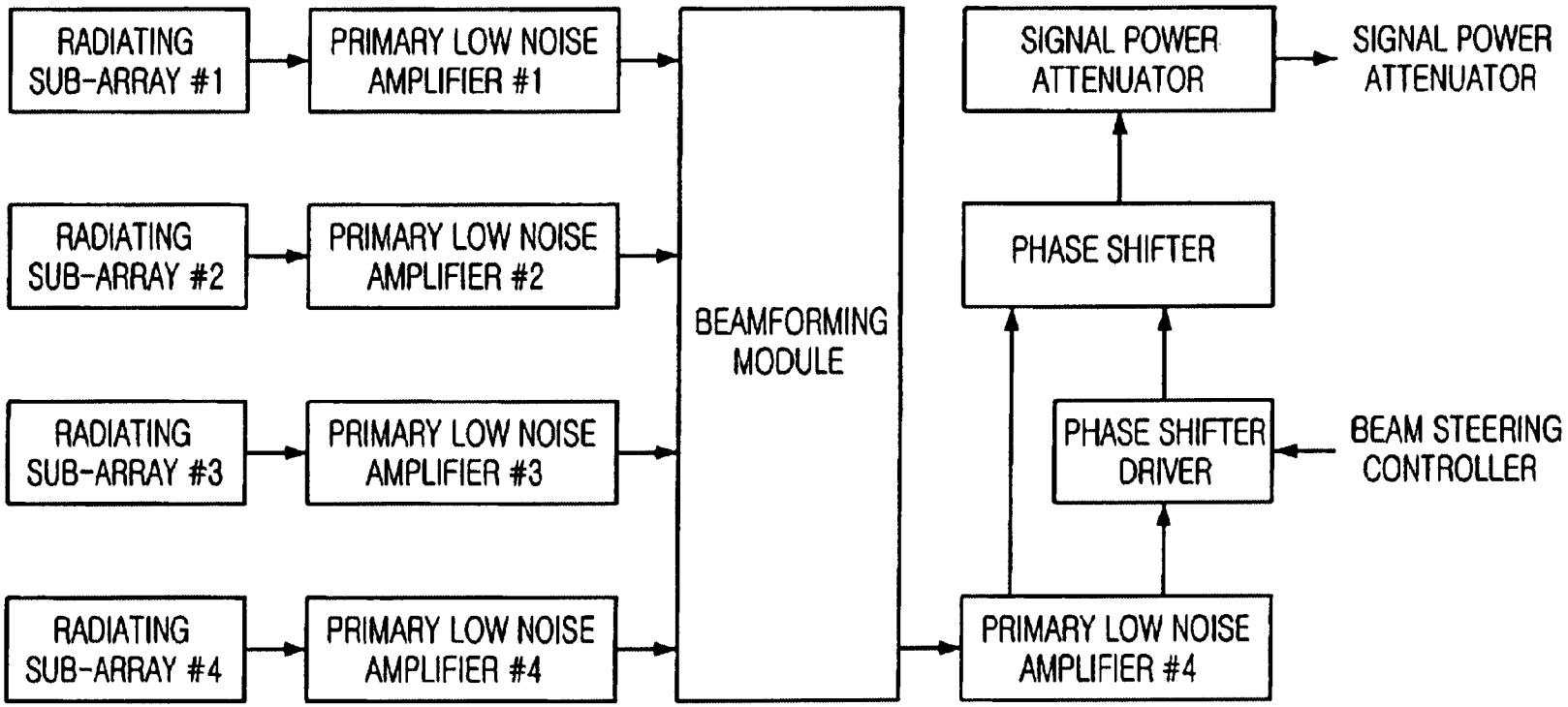
FIG. 4 (PRIOR ART)
FIG. 4 is a detailed block diagram of an active channel sub-module shown in FIG. 3.
Figure 5:
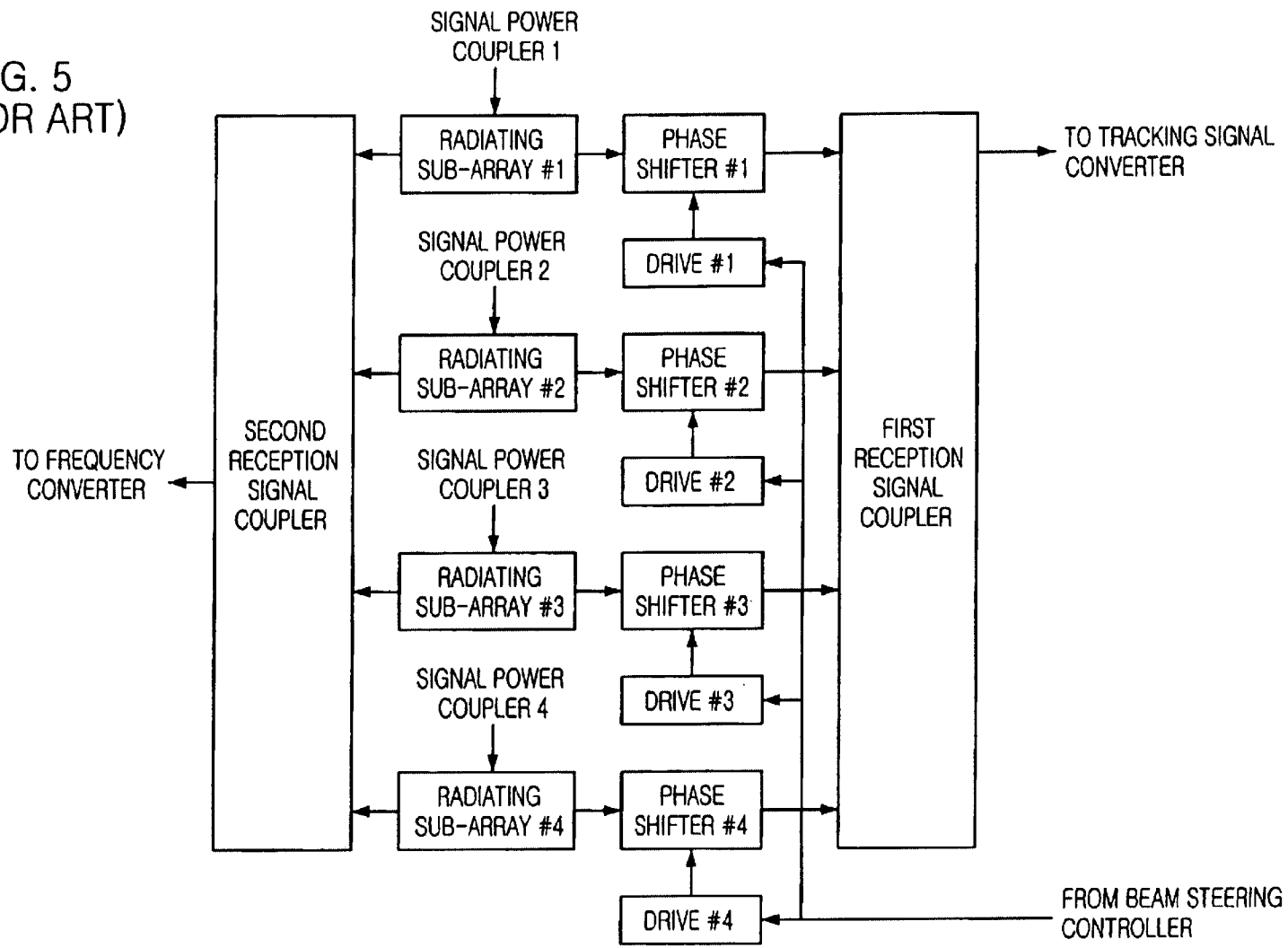
FIG. 5 (PRIOR ART)
FIG. 5 is a detailed block diagram of a beamforming module shown in FIG. 3.
Figure 6:
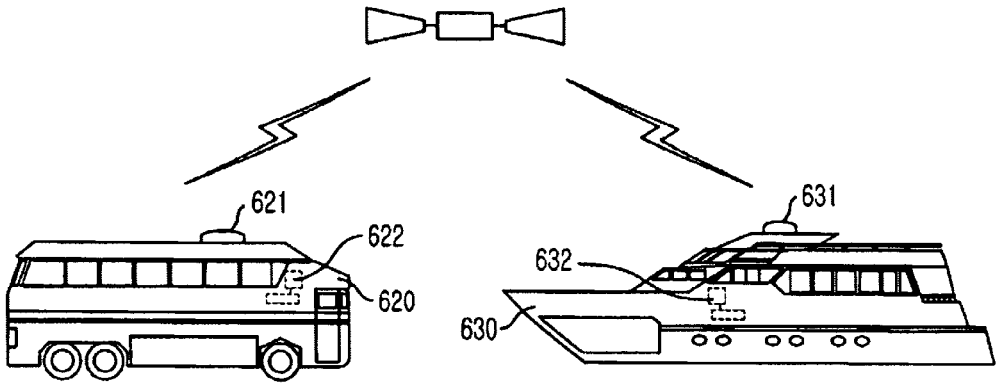
FIG. 6 is an explanatory diagram of a satellite communication system in accordance with the present invention.

FIG. 6 is an explanatory diagram of a satellite communication system in accordance with the present invention.

As shown, a satellite 610 and a vehicle 620 or a vessel 630 transmit/receive up/down satellite signals through antenna systems 621 and 631 for the satellite communication in accordance with the present invention, thereby maintaining a communication environment between each other.

In a transmission, that is, when the vehicle 620 transmits a signal to the satellite 610, the antenna system 621 for the satellite communication of the moving vehicle 620 receives a signal from a communication terminal 622 disposed inside the vehicle and then converts the signal into a satellite frequency signal to output a radio frequency signal to the satellite 610. In a reception, that is, when the vehicle 620 receives a signal from the satellite 610, the antenna system for satellite communication converts the received signal into a frequency signal suitable for the communication terminal 622.

In the same manner, a bi-directional communication between the vessel 630 and the satellite 610 is possible.

Figure 7:
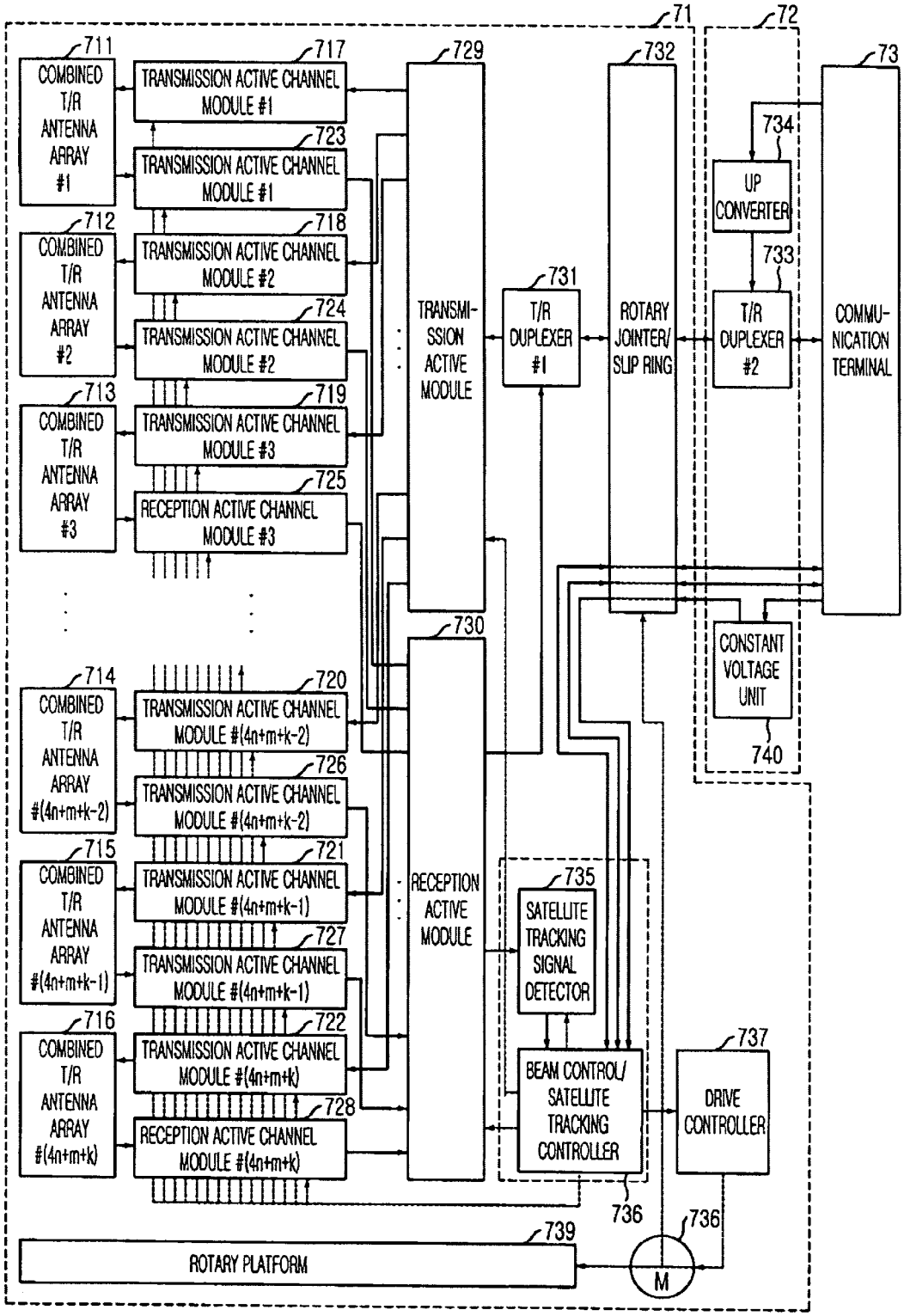
FIG. 7 is a block diagram of an antenna system for satellite communication in accordance with the present invention.

FIG. 7 is a block diagram of the antenna system for the satellite communication in accordance with an embodiment of the present invention.

Referring to FIG. 7, the antenna system according to the present invention includes a rotating part 71 and a fixed part 72. The rotating part 71 and the fixed part 72 transfer the transmission/reception signal, the necessary power of the rotating part 71 and information signals through a rotary jointer and slip ring 732 with each other.

The present invention uses one ultra high frequency signal transfer path, and the transmission signal transferred from the satellite is transferred to the antenna system through a communication terminal 73. An up converter 734, called an "up frequency converter", up-converts the frequency of the signal into the transmission frequency of the satellite.

A drive controller 737 functions to receive an azimuth information of the current satellite from a beam control and satellite tracking controller 736 and generate a current according to the azimuth information. The drive controller 737 supplies the power to a motor 738 and the motor 738 functions to drive a rotating member of the antenna or system for the satellite communication. Further, a rotary platform 739 is rotated by a rotation driving force supplied from the motor 738.

Hereinafter, the reception of signal transmitted from the satellite will be described in detail with reference to FIGS. 7 and 8.

Figure 8:
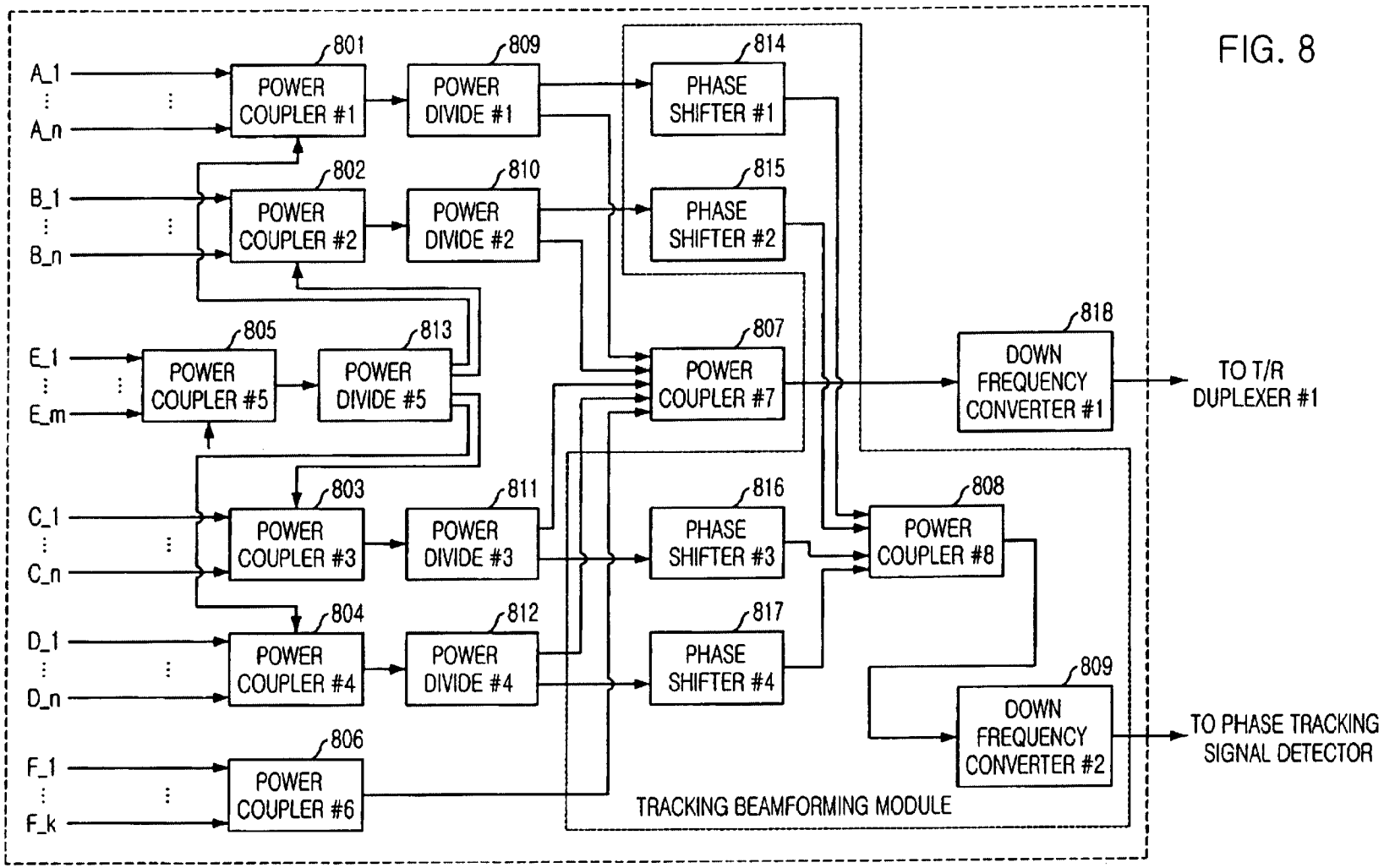
FIG. 8 is a detailed block diagram of a reception active module shown in FIG. 7 in accordance with an embodiment of the present invention.

FIG. 8 illustrates the reception active module of FIG. 7 in accordance with an embodiment of the present invention, which will be described later in detail.

The signal transmitted from the satellite to the antenna system of the present invention is converted into a low frequency by a down frequency converter #1 818 of the reception active module 730 and then transferred to the communication terminal 73 through one path of the rotary jointer and slip ring 732 using transmission/reception duplexers #1 731 and #2 733.

On the contrary, the up converter 734 for converting the transmission frequency of the terminal system transferring the signal to the satellite into the up frequency is disposed between the transmission/reception duplexer #2 733 and the communication terminal 73 and transfers the signal to the transmission active module 729 through one path of the rotary jointer and slip ring 732 by using the transmission/reception duplexers #1 731 and #2 733.

By transmitting the signal in the above manner, it is possible to transmit/receive the satellite signal through one ultra high frequency transmission path of the rotary joint and slip ring 732 at the same time.

Herein, a basic structure of the rotary jointer and slip ring 732 will be described. A power line and a signal line disposed above and below the slip ring are not crossed with each other and the rotary jointer is connected to an exterior through a coaxial cable that is an ultra high frequency connection line.

A satellite transmission/reception connection terminal for the communication terminal 73, a power line and terminals for information exchange between communication terminals are disposed at the fixed part 72. Additionally, the fixed part 72 includes the up converter 734, the transmission/reception duplexer #2 733 and a constant voltage unit 740. The up converter 734 functions to up-convert the frequency of the transmission signal which is inputted from the communication terminal 73 and transmitted to the satellite. The transmission/reception duplexer #2 733 transfers the up-converted signal to the rotary jointer and slip ring 732 and transfers the satellite reception signal to the communication terminal 73. Here, the satellite reception signal is a signal that is converted into a low frequency by the rotary jointer and slip ring 732. The constant voltage unit 740 functions to convert the voltage supplied from the communication terminal 73 into a voltage that is suitable for the rotating part 71.

The rotating part 71 is configured with a module disposed above the rotating member together with the rotary platform 739.

Herein, a process of transmitting the signal to the satellite by means of the rotating part 71 will be described below. The transmission signal supplied from the rotary jointer and slip ring 732 is transferred to the transmission active module 729 through the transmission/reception duplexer #1 731.

Figure 9:
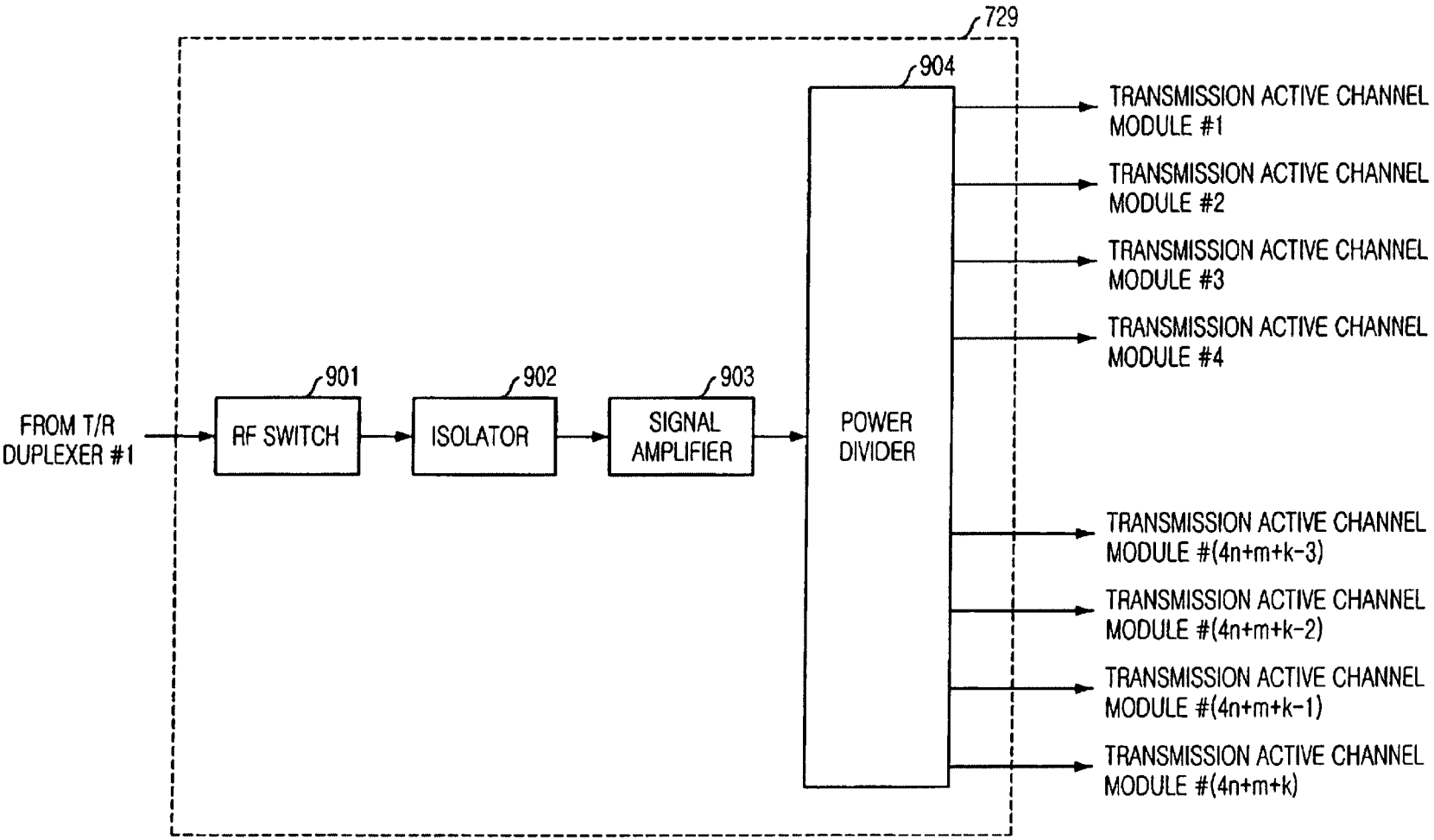
FIG. 9 is a detailed block diagram of a transmission active module shown in FIG. 7 in accordance with an embodiment of the present invention.

FIG. 9 is a detailed block diagram of the transmission active module shown in FIG. 7 in accordance with an embodiment of the present invention.

Referring to FIG. 9, the transmission active module according to the present invention includes an RF switch 901, an isolator 902, a signal amplifier 903, and a power divider 904.

In case it fails to catch the position of the satellite that is now communicating, the RF switch 901 functions to cut off the transmission signal in order to prevent the antenna system from affecting the communication environment of other satellites while finding other satellite.

The signal amplifier 903 functions to amplify the signal to be transmitted, and the isolator 902 is disposed between the RF switch 901 and the signal amplifier 902 to isolate a reverse flow of signal, thereby securing their own characteristics.

The power divider 904 functions to receive an output of the signal amplifier 903, divide it into signals having the same phase and strength, and supply the divided signals to the transmission active channel modules. Here, the number of the transmission active channel module is identical to the number of the antenna array.

The transmission active channel modules 717 to 722 functions to process the signal supplied from the transmission active module 729 to have the desired phase and strength by using the satellite position information supplied from the beam control and satellite tracking controller 736, the phase shifters (not shown) and the amplifiers (not shown) of the transmission active channel modules 717 to 722, and functions to transmit the processed signal to the combined transmission/reception antenna arrays 711 to 716.

Figure 10:
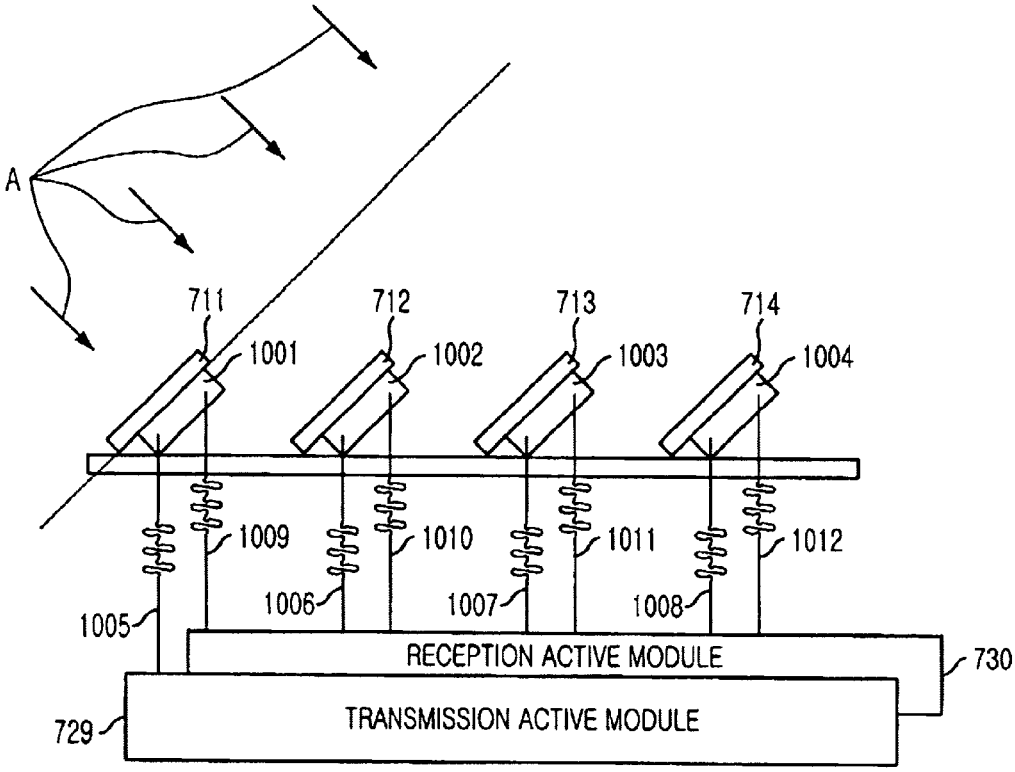
FIG. 10 is an explanatory diagram showing an array configuration of an antenna system shown in FIG. 7.

FIG. 10 is an explanatory diagram showing an arrangement configuration of the antenna system shown in FIG. 7.

As shown, the antenna system according to the present invention has four step structures. For the sake of convenience, modules 1001 to 1004 having transmission active channel modules and reception active channel modules combined with each other will be described below as an example.

According to the antenna system of the present invention, lengths of the lines are set differently according to the positions of the antenna arrays. Here, the transmission active module 729, the reception active module 730, and the modules 1001 to 1004 having the transmission active channel modules and the reception active channel modules combined with each other are connected to the lines.

For example, in the case of the reception signal A transmitted from the satellite, the lengths between the satellite and the antenna arrays 711 to 714 are different from each other according to the positions of the antenna arrays. According to the present invention, the transmission active channel modules 717 to 722 and the reception active channel modules 723 to 728 are directly connected to the antenna arrays. Additionally, the distance differences between the satellite and the antenna arrays are compensated in the connection lines 1009 to 1012 between the combined transmission/reception active channel modules 1001 to 1004 and the reception active module 730. Here, the combined transmission/reception active channel modules 1001 to 1004 are provided by manufacturing the transmission active channel modules and the reception active channel modules in one body.

As a result, the distance difference of the signals received/transmitted from/to the satellite according to the positions of the respective antenna arrays can be compensated using the differences of the connection lines between the reception active channel modules and the reception active modules and the differences of the connection lines between the transmission active channel modules and the transmission active modules.

In order to transmit/receive the signal in a plane direction with respect to the satellite disposed in an arbitrary direction, the antenna arrays 711 to 714 according to the present invention have the step structure of a predetermined angle. Therefore, in order to identically adjust the electrical length of the plane wave A, which reaches the plane of the antenna from the satellite, it is possible to use RF cable lines 1006 to 1012 having the length differences that are capable of compensating the electrical propagation delay length according to the antenna arrays 711 to 714.

Hereinafter, the process of transmitting the reception signal supplied from the antenna array and the satellite to the communication terminal 73 and the process of generating the control signal for satellite tracking will be described in detail with reference to FIGS. 7, 8 and 11.

Figure 11:
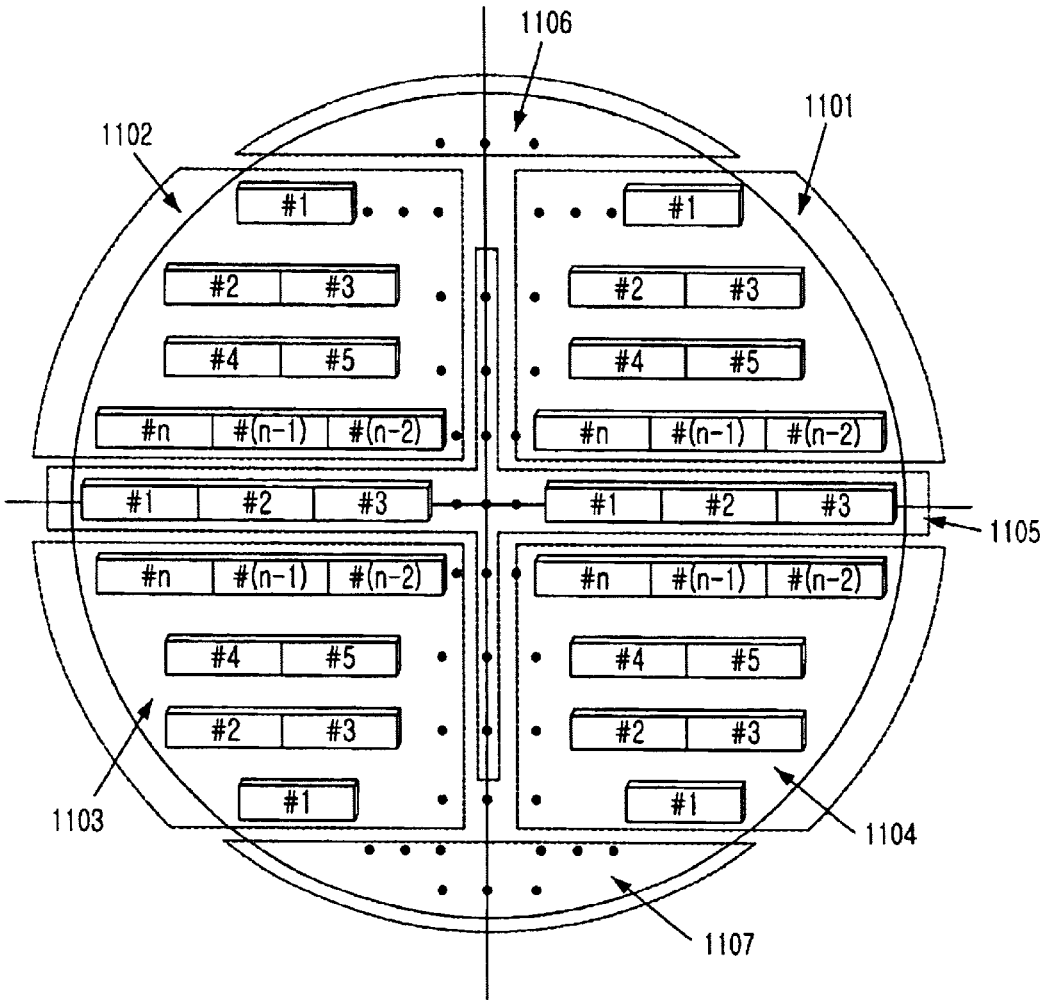
FIG. 11 illustrates an arrangement of a combined transmission/reception antenna array of FIG. 7.

FIG. 11 illustrates an arrangement of the combined transmission/reception antenna array of FIG. 7.

As shown, the antenna array according to the present invention includes four sub-arrays 1101 to 1104 each having the same number ("n" in this embodiment), the m number of antenna arrays 1105 disposed at the boundary portion of each sub-array, and the k number of antenna arrays 1106 and 1107.

All the antenna arrays of the antenna system according to the present invention transmit the signals to the reception active channel modules connected to the respective antenna arrays. The reception active channel module detects the satellite signal, which is obtained at the antenna array, by using a frequency band filter. Further, in order to obtain the low noise amplification and desired phase, the reception active channel module provides the detected satellite signal to the reception active module 730 through the phase shifter.

The phase shifter (not shown) of the reception active channel module is controlled by the signals of the beam control and satellite tracking controller 736.

In case the antenna array signals corresponding to the four sub-arrays each having the same number and being symmetrical with respect to an up/down central axis and a right/left central axis of the antenna array are supplied from the reception active channel module, the reception active module 730 couples the ultra high frequency signals in the same type by using the power couplers #1 801, #2 802, #3 803 and #4 804 of FIG. 8.

When the signals are transmitted to the reception active module 730 through the reception active channel module, the antenna array 1105 disposed at the boundary portion of the four sub-arrays of FIG. 11 couples the signals with each other by using the power coupler #5 805 and transmits the coupled signals to the power couplers #1 801, #2 802, #3 803 and #4 804 according to the positions of the boundary portions by using the power divider #5 813.

Further, the signals of the antenna arrays that are not contained in both the four sub-arrays and the antenna arrays disposed at the boundary portions are passed through the reception active channel module and coupled with each other by the power coupler #6 806 when the signals are inputted to the reception active module.

The signals of the power couplers #1 801, #2 802, #3 803 and #4 804 are distributed to two paths by the power dividers #1 809, #2 810, #3 811 and #4 812. Here, the signals of the power couplers #1 801, #2 802, #3 803 and #4 804 are signals that are generated by coupling the signals of the antenna arrays corresponding to the four sub-arrays having the same structure and shapes and the signals of the antenna arrays disposed at the boundary portions. The signals distributed to one path are coupled by the power coupler #7 807, and the signals distributed to the other path is passed through the phase shifters #1 814, #2 815, #3 816 and #4 817 and then coupled by the power coupler #8 808.

The phases of the phase shifters #1 814 to #8 817 are controlled by the signal supplied from the beam control and satellite tracking controller 736.

The signals coupled by the power coupler #8 808 are provided to the satellite tracking signal detector 735 through the down frequency converter #2 819. The satellite tracking signal detector 735 converts the strength of the ultra high frequency signal into that of DC voltage.

The beams that are primarily formed at the phase shifters of the reception active channel modules connected to the respective antenna arrays are secondarily generated as the beam signals adjacent to the satellite by the phase shifters #1 814 to #4 817.

The beam signals adjacent to the satellite are obtained from the signals obtained at the antenna arrays by using the four phase shifters #1 814 to #4 817 and then provided to the satellite tracking signal detector 735. In other words, it is determined whether or not the directional beam of the current antenna array is under the optimum communication environment together with the current communicating satellite. if the directional angle of the current antenna array is not the optimum communication environment, the corresponding information is provided to the satellite tracking signal detector 735.

The power coupler #7 807 couples the signals of the power coupler #6 806 and provides the combined signals to the down frequency converter #1 818. Here, the signals of the power coupler #6 806 are signals that are provided by coupling the signals of the four sub-arrays providing the satellite tracking information and the signals of the antenna arrays that are not the antenna arrays disposed at the boundary portions. The down frequency converter #1 818 performs the down frequency conversion with respect to the combined signals and then provides the converted signals to the communication terminal 73 through the transmission/reception duplexer #1 731, the rotary jointer and slip ring 732 and the transmission/reception duplexer #2 733. This process is performed for maximally using all the reception signals of the antenna arrays.

Figure 12:
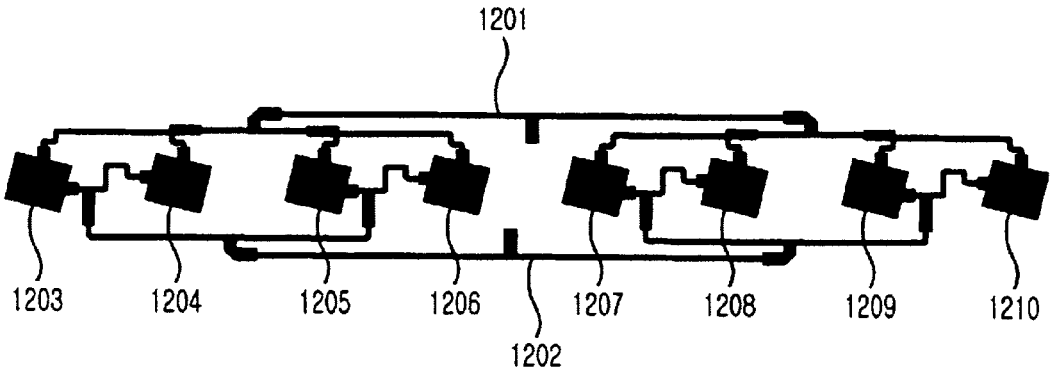
FIG. 12 illustrates an exemplary diagram of a combined transmission/reception antenna array of FIG. 7.

FIG. 12 illustrates an exemplary diagram of the combined transmission/reception antenna array of FIG. 7 in accordance with an embodiment of the present invention, in which eight unit radiating elements are coupled to form one antenna array.

As shown, the unit radiating elements 1203 to 1210 are configured to simultaneously achieve the transmission/reception functions to/from the satellite according to the respective radiating elements. The antenna array according to an embodiment of the present invention includes an antenna transmission input terminal 1201 for transmitting the signals of the communication terminal 73 to the satellite and an antenna reception output terminal 1202 for providing the signals of the satellite to the communication terminal 73.

It is characterized that the unit radiating elements 1203 to 1210 are inclined at the same angle as the satellite in order to maintain an angle of polarization with respect to the satellite.

Figure 13:
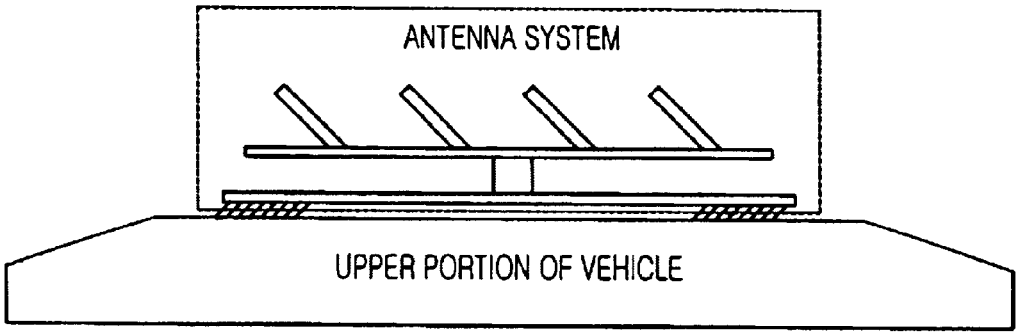
FIG. 13 illustrates an antenna system attached to a moving vehicle in accordance with an embodiment of the present invention.

FIG. 13 illustrates the antenna system attached to the moving vehicle in accordance with an embodiment of the present invention. FIG. 13 shows the case where an elevation tracking range of the antenna is allowable in the environmental conditions, such as a tilt angle of topography, in which the moving vehicle is operable.

Figure 14:
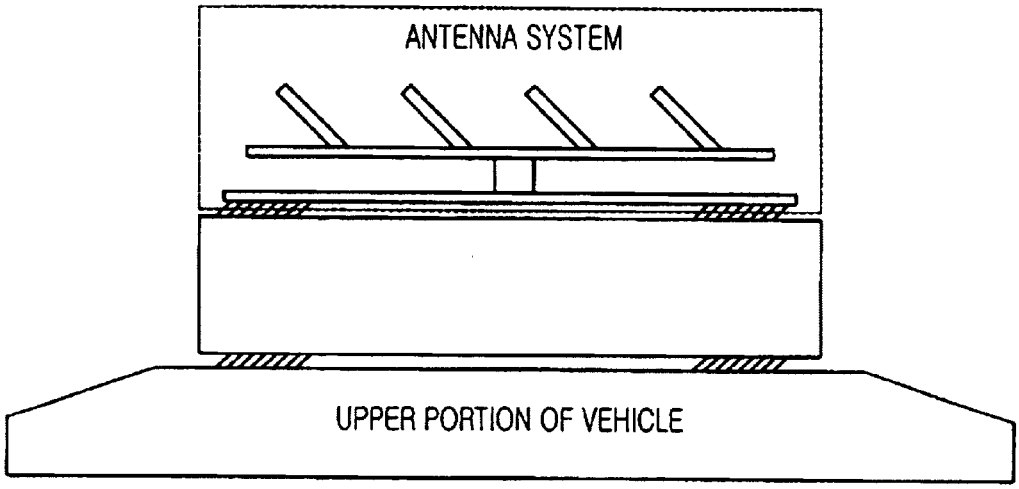
FIG. 14 illustrates an antenna system attached to a moving vessel in accordance with an embodiment of the present invention.

FIG. 14 illustrates the antenna system attached to the moving vessel in accordance with an embodiment of the present invention. It can be seen from FIG. 14 that the operating range is expanded using a vertical motion correcting apparatus in case the elevation tracking range of the antenna does not satisfy the environmental conditions, such as the tilt angle of the topography, in which the moving object is operable.

Figure 15:
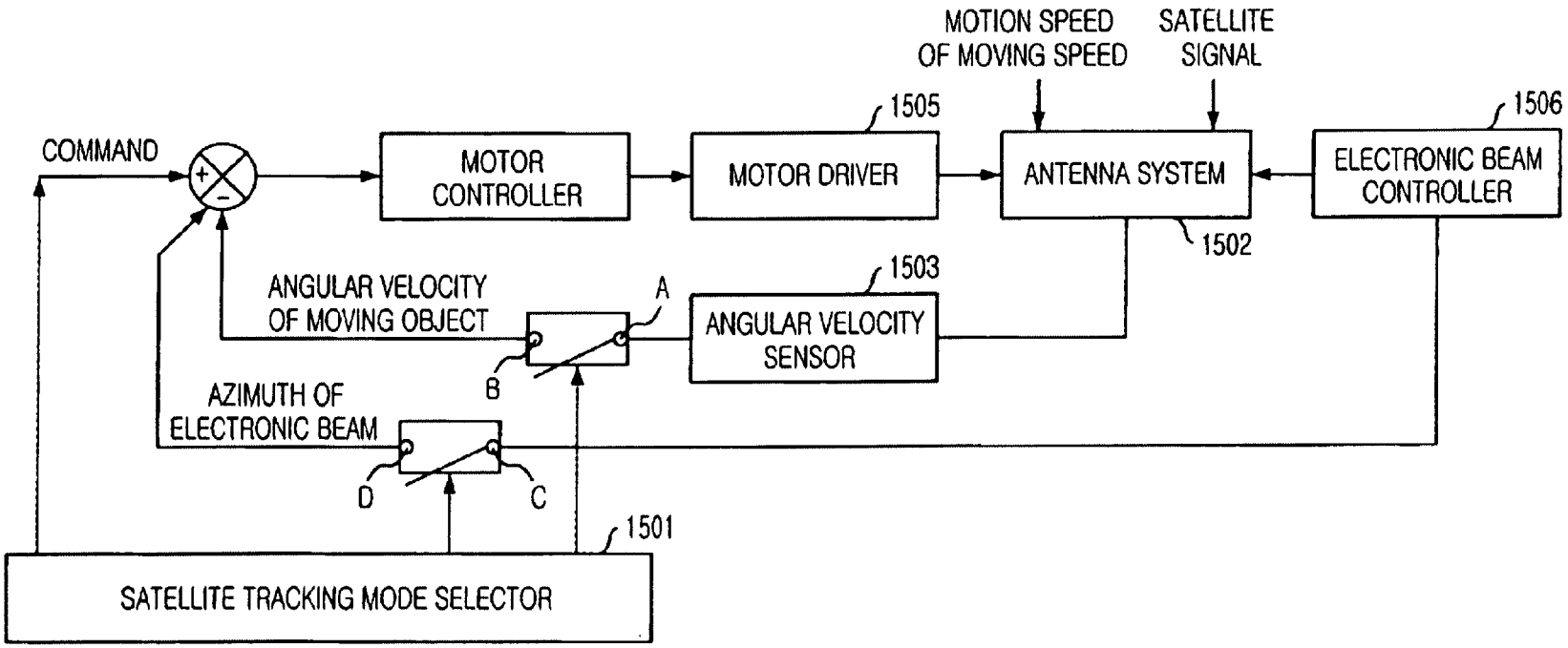
FIG. 15 is a block diagram illustrating a configuration of a satellite signal tracking system which employs a method for tracking satellite signal in accordance with the present invention.

FIG. 15 is a block diagram illustrating a configuration of the satellite signal tracking system which employs a method for tracking the satellite signal in accordance with the present invention.

As shown, the method for tracking the satellite signals in accordance with the present invention is characterized in that a satellite tracking mode selector 1501 opens or closes a corresponding control loop according to a tracking mode.

According to the present invention, in the case of an initial tracking and a repetitive tracking mode, a terminal A and a terminal B are connected to each other. A command of deg/s (in this embodiment, 45°/s) command is achieved by the satellite tracking mode selector 1501 and a moving object angular velocity feedback is achieved by an angular velocity sensor 153 connected to the antenna system 1502 according to the present invention. The azimuth of the antenna can be controlled mechanically to make the corresponding error to be "0".

Meanwhile, in the case of an autotracking mode, a terminal c and a terminal D are connected to each other. At this time, the command is 0°/s. The feedback is an electronic azimuth of the antenna. The antenna system according to the present invention can mechanically control the azimuth in order to make the corresponding error to be "0".

Hereinafter, an operation of the respective elements will be described in detail with reference to FIGS. 16 to 19.

Figure 16:
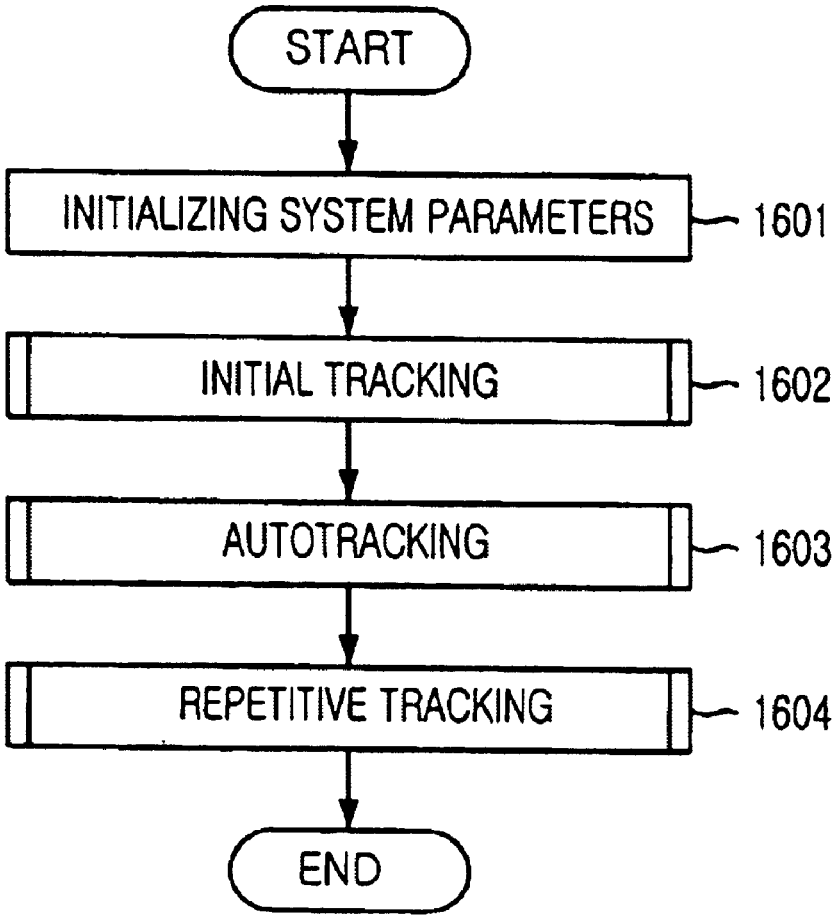
FIG. 16 is a flowchart illustrating a method for tracking satellite signal using an antenna system for satellite communication in accordance with the present invention.

FIG. 16 is a flowchart illustrating the method for tracking the satellite signals using the antenna system for satellite communication in accordance with the present invention.

Referring to FIG. 16, if the antenna system is powered on and an algorithm starts, system parameters are initialized (1601) and an initial tracking is then carried out (1602). Considering an initial motion velocity of the moving object attached to the antenna system, the initial tracking of the satellite signal is carried out using the angular velocity received from the angular velocity sensor 1503. The satellite signal is tracked electronically in an elevation direction and tracked mechanically/electronically in an azimuth direction. The initial tracking is finished at a time when the satellite is caught.

After the initial tracking is completed, an autotracking is carried out (1603). The autotracking of the satellite signal uses signal levels of four beams (an upper beam, a lower beam, a left beam, a right beam) in order not to fail to catch the satellite signals. Therefore, the satellite signals can be caught continuously.

During the autotracking, an instantaneous signal loss may occur when trees or external objects block the satellite signal. A repetitive tracking is carried out (1604). In other words, the satellite signal is tracked electronically in an elevation direction and tracked mechanically/electronically in an azimuth direction at the position where the loss of the satellite signal occurs.

Herein, the respective processes of FIG. 16 will be described in detail with reference to FIGS. 17 to 19.

Figure 17:
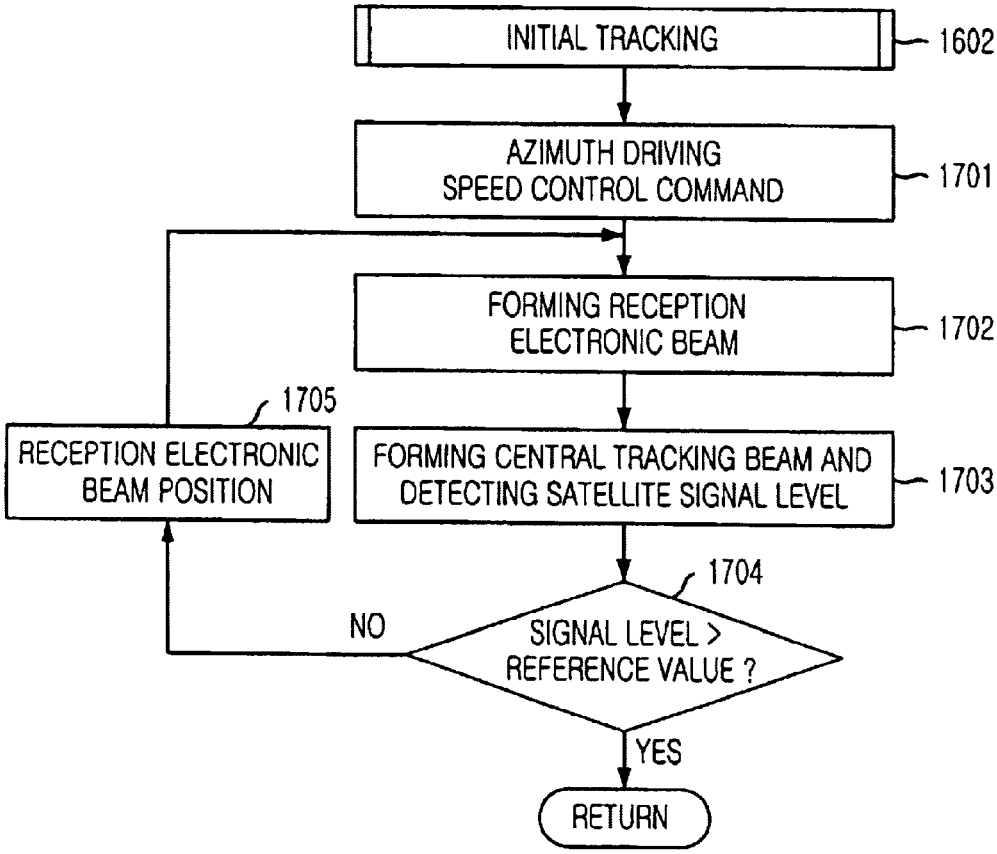
FIG. 17 is a flowchart illustrating an initial tracking process of FIG. 16 in accordance with an embodiment of the present invention.

FIG. 17 is a flowchart illustrating the initial tracking process of FIG. 16 in accordance with an embodiment of the present invention.

As shown, if the initial tracking mode starts, a command to cause the rotating part 71 of the antenna system to rotate at a constant speed is transferred to the motor controller 1504 at step 1701, so that the motor controller 1504 controls the motor driver 1505 so that the motor can rotate at a constant speed in an azimuth direction.

Then, a phase code for controlling the phase shifter of the reception active channel module is calculated. The calculated phase code is loaded into the reception active channel module to form the reception electron beam at step 1702.

Then, a phase code for forming a central tracking beam is calculated. The calculated phase code is loaded into the tracking beamforming module to form the central tracking beam. During this process, the satellite signal level is detected from the tracking signal converting module at step 1703.

Here, the tracking beamforming module is a module including the phase shifters #1 814 to #4 817, the power coupler #8 808 and the down frequency converter #2 809, as shown in FIG. 8.

Further, the tracking signal converting module is a module including the satellite tracking signal detector 735 and the beam control and satellite tracking controller 736, as shown in FIG. 7.

The detected satellite signal level is compared with a reference value at step 1704. If the signal level is larger than the reference value, the initial tracking process is finished and the autotracking process is carried out. If the reference value is larger than the signal level, the position of the reception electron beam is updated at step 1705. Then, the process returns to the step 1702 and the above steps 1702 to 1704 are repeated until the satellite signal level is larger than the reference value.

Figure 18:
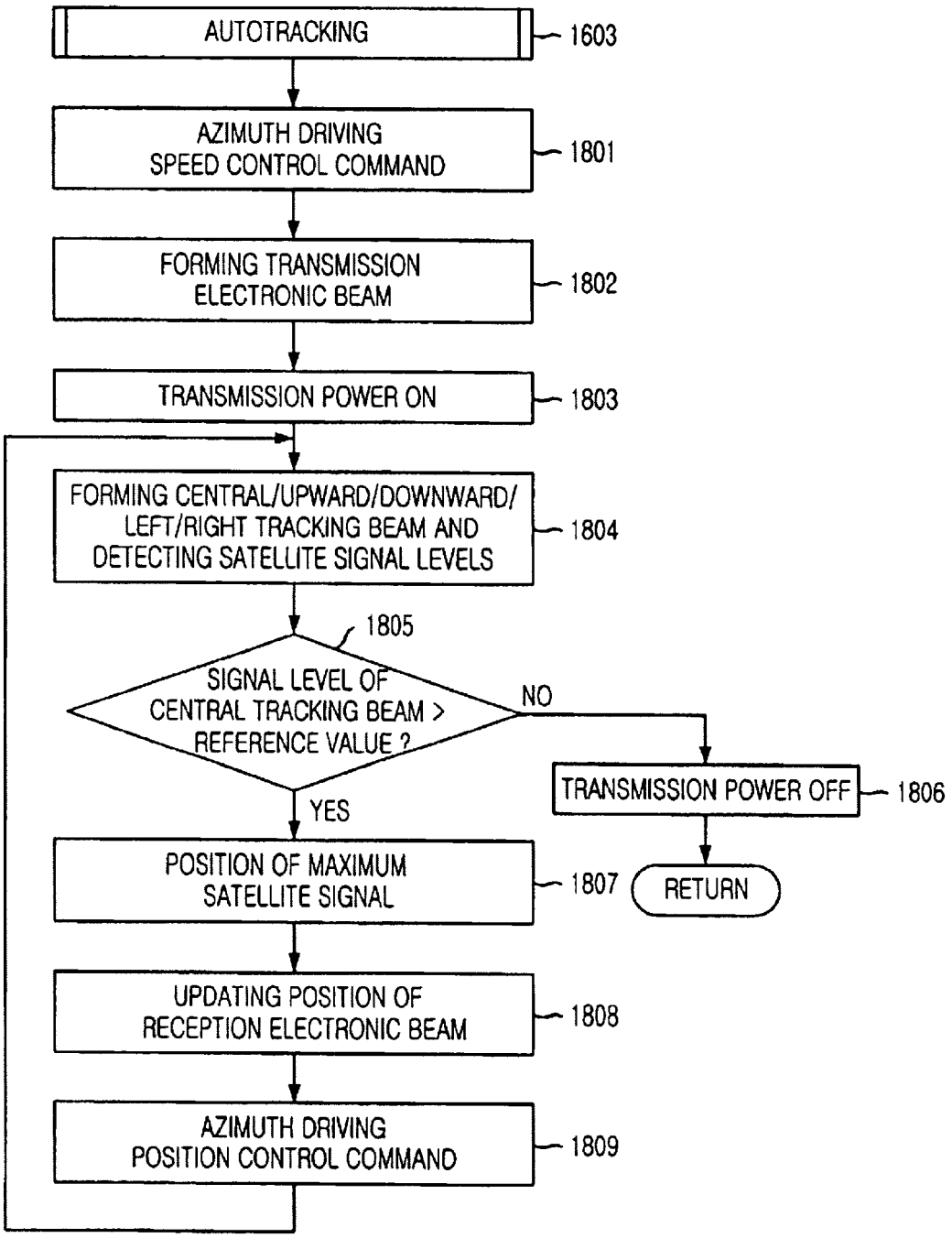
FIG. 18 is a flowchart illustrating an autotracking process of FIG. 16 in accordance with an embodiment of the present invention.

FIG. 18 is a flowchart illustrating the autotracking process of FIG. 16 in accordance with an embodiment of the present invention.

As shown, according to the autotracking process of the present invention, at step 1801, the azimuth drive position control command is transferred to the motor controller 1504, causing the drive of the azimuth motor to be stopped.

In order to form the transmission electron beam, a phase code according to a corresponding scanning angle is calculated. The calculated phase code is loaded into the transmission active channel module to form the transmission electron beam at step 1802 and the transmission power is on at step 1803.

Then, a phase code for forming the tracking beam toward the center identical to the direction of transmission beam, is calculated and loaded into the tracking beamforming module. The corresponding satellite signal level is detected from the tracking signal converting module and then stored. In the same manner, an upward tracking beam, a downward tracking beam, a left tracking beam and a right tracking beam are formed and the satellite signal levels are detected at the respective positions and then stored at step 1804.

Then, the stored satellite signal level value of the central tracking beam is compared with a reference value at step 1805. If the satellite signal level of the central tracking beam is smaller than the reference value, the transmission power is off at step 1806 and the repetitive tracking process is carried out.

If the satellite signal level is larger than the reference value, the stored upward, downward, left and right satellite signal level values are compared to determined the position of the satellite signals at step 1807. The position of the reception electronic beam is updated in a direction of the largest value among the values at step 1808. For this, the corresponding phase code is calculated and loaded into the transmission active channel module.

The steering azimuth of the corresponding electronic beam is fed back to the motor controller 1504 to control the azimuth motor to have the electronic azimuth steering angle of "0" at step 1809.

Then, the process proceeds to the step the step 1804.

Figure 19:
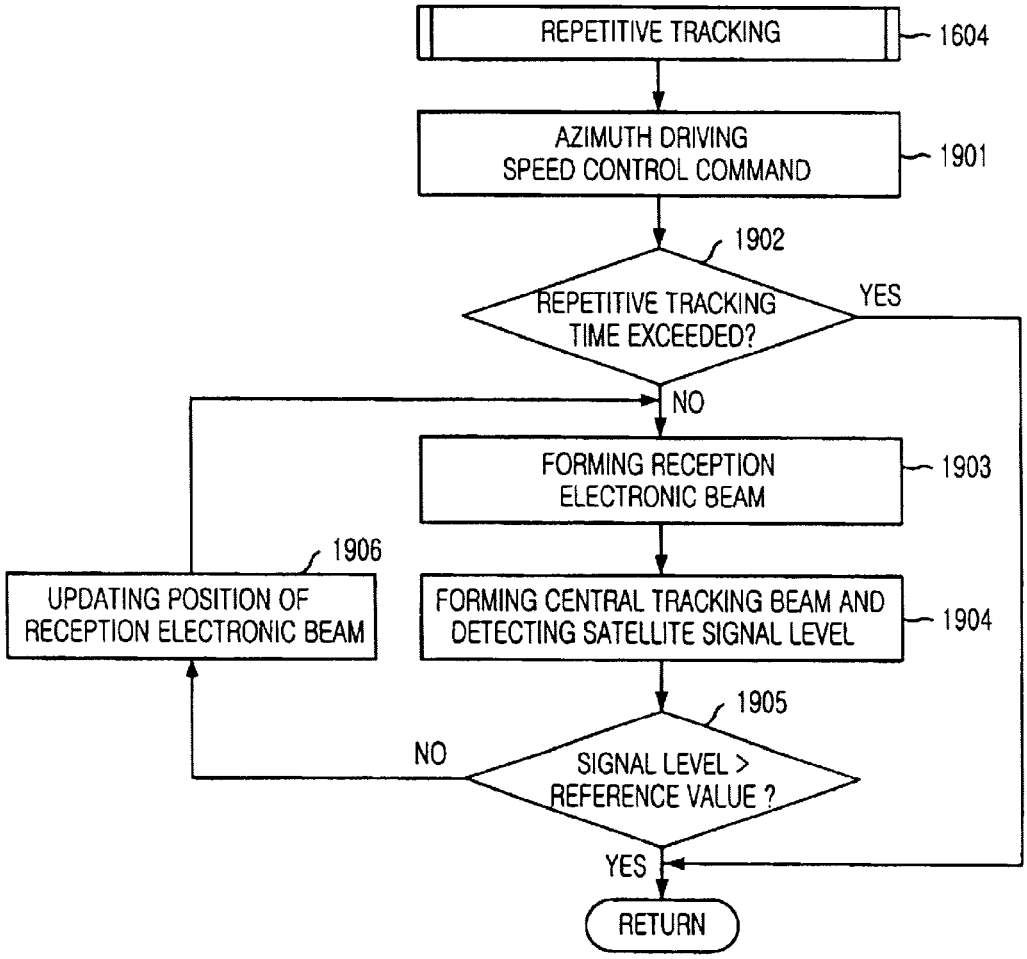
FIG. 19 is a flowchart illustrating a repetitive tracking process of FIG. 16 in accordance with an embodiment of the present invention.

FIG. 19 is a flowchart illustrating the repetitive tracking process of FIG. 16 in accordance with an embodiment of the present invention.

A shown, according to the repetitive tracking process, a command for causing the motor to repetitively move right and left within a predetermined range is transferred to the motor controller 1504 at step 1901.

If a set repetitive tracking time is exceeded at step 1902, the repetitive tracking is finished and the initial tracking process is carried out.

If the set repetitive tracking time is not exceeded, a phase code for forming the reception electronic beam to the corresponding angle is calculated and loaded into the reception active channel module. Further, a phase code for forming the reception electronic beam in the corresponding direction is calculated and loaded into the reception active channel module at step 1903.

Then, a phase code for forming the central tracking beam is calculated and loading into the tracking beamforming module. The corresponding satellite signal level is detected from the tracking signal converting module at step 1904.

The detected satellite signal level is compared with a reference value at step 1905. If the satellite signal level is larger than the reference value, the repetitive tracking is finished and the autotracking process is carried out. If the satellite signal level is smaller than the reference value, the position of the reception electronic beam is updated at step 1906. Then, the process returns to the step 1903 and the above steps 1903 to 1905 are repeated until the satellite signal level is larger than the reference value.

The present invention has various effects as follows.

First, since both one-dimensional phase array control of the elevation and azimuth and one-dimensional mechanical control are used, it is possible to provide the economical and effective system compared with two-dimensional phase array antenna, and the satellite tracking speed performance is improved compared with the two-dimensional mechanically controlled antenna.

Second, in case the satellite is tracked using the double beam, the antenna performance is improved by using an efficient antenna array that can form the optimum double beam and maximally utilize the satellite signal according to the antenna array.

Third, in the two-dimensional satellite tracking, the signal received from the satellite is used. The optimum transmission performance can be maintained because the different phases are assigned to the respective antenna array by calculating a current position of the satellite that is in use and by automatically calculating the frequency of the transmission signal and the intervals between the antennas.

Fourth, in case the antenna system fails to catch the position of the satellite that is in use, the ultra high frequency switch is used for preventing the signal transmission. Therefore, it is possible to prevent an influence on the communication environment of other satellites.

Fifth, since the transmission signal and the reception signal of the antenna system are processed through one communication line by using the up frequency converter and the down frequency converter. Therefore, it is possible to easily connect the rotating part and the fixed part of the antenna system with each other.

Sixth, since the transmission active channel module and the reception active channel module are disposed on the back of the antenna array as one body, thereby reducing the loss. It is possible to improve the efficiency and performance of the antenna system.

Seventh, the lengths of connection lines between the transmission active channel module and the transmission active module and between the reception active channel module and the reception active module are different according to the positions of the antenna arrays. Therefore, it is possible to prevent the propagation delay according to the positions of the antenna arrays.

Eighth, in the satellite tracking of the azimuth direction using the motor, the multi control loop method is used. Therefore, it is possible to set the communication environment using the optimum satellite within a fast time in the motion of the object and the initial tracking environment.

Ninth, it is possible to provide the antenna system that satisfies the operating environment conditions of the moving object by using the vertical motion correcting apparatus and exchanging information with the vertical motion correcting apparatus with respect to the operating environment conditions that exceed the motion conditions of the present invention.

While the present invention has been described with respect to the particular embodiments, it will be apparent to those skilled in the art that various changes and modifications may be made without departing from the scope of the invention as defined in the following claims.

What is claimed is:

1. An antenna system for satellite communication including a transmission/reception connecting means for a communication terminal and an information exchanging means for tracking an elevation electronically and tracking a satellite electronically/mechanically, the antenna system comprising:

a plurality of array antennas for transmitting/receiving a signal to/from a satellite;

a plurality of reception active channel modules for performing a low noise amplification to a predetermined frequency of a satellite signal inputted through the plurality of array antennas and for shifting the frequency to a desired phase;

a reception active module for receiving the satellite signal from the plurality of reception active channel modules, coupling the satellite signals according to positions of the antenna arrays, and transmitting the coupled satellite signals to the communication terminal through the transmission/reception connecting means;

a first conversion means for receiving the signals from the communication terminal and up-converting the signal into a satellite frequency;

a transmission active module for amplifying/dividing the signals inputted from the first conversion means through the transmission/reception connecting means;

a plurality of transmission active channel modules for controlling a phase of the signals inputted from the transmission active module and transmitting the phase-controlled signals to the array antenna;

a first control means for controlling the plurality of reception active channel modules, the reception active module, the plurality of transmission active channel modules and the transmission active module by using a satellite tracking signal inputted from the reception active module;

a first transmission/reception duplexer for transmitting the output signal of the reception active module to the transmission/reception connecting means and transmitting a signal outputted from the transmission/reception connecting means to the transmission active module; and a second transmission/reception duplexer for transmitting a signal inputted through the transmission/reception connecting means to the communication terminal and transmitting a signal from the communication terminal to the transmission/reception connecting means, wherein the transmission active module includes:

an amplifying means for amplifying a signal to be transmitted to the satellite;

a dividing means for diving the signal outputted from the amplifying means and providing the divided signals to the plurality of transmission active channel modules;

a switching means for blocking the transmission of the signal to the satellite; and an isolating means for preventing a reverse flow of signal between the switching means and the amplifying means to secure characteristics thereof.

2. The antenna system as recited in claim 1, further comprising:

a second control means for receiving an azimuth information of a current satellite from the first control means and generating a current according to the azimuth information;

a drive means for receiving the current from the second control means and driving a rotating member of the antenna system; and a platform configured to rotate by a rotation driving force.

3. The antenna system as recited in claim 1, wherein the reception active module includes:

a plurality of coupling means for coupling signals of sub-arrays having the same array structure among the array antennas;

a first coupling means for coupling signals of a first array disposed at boundary portions of the sub-arrays among the array antennas;

a first dividing means for dividing signals of the first coupling means and providing the divided signals to the plurality of coupling means;

a second coupling means for coupling signals of a second array, the second array being an array except for the sub-arrays and the first array;

a plurality of dividing means for dividing the signals inputted from the plurality of coupling means;

a third coupling means for coupling the signals of the plurality of coupling means and the signals of second coupling means;

a second converting means for down-converting a frequency of the signal inputted from the third coupling means; and a tracking beam_forming module for forming a beam signal adjacent to the satellite by using the signals of the plurality of dividing means.

4. The antenna system as recited in claim 3, wherein the tracking beam_forming module includes:

a plurality of phase shifters for shifting phases of the signals outputted from the plurality of dividing means;

a four coupling means for coupling the signals outputted from the plurality of phase shifters; and a third converting means for down-converting frequencies of the signals outputted from the four coupling means.

5. The antenna system as recited in claim 1, wherein the first control means includes:

a second converting means for converting a strength of the signal inputted from the reception active module into a strength of a DC voltage; and a third control means for controlling the plurality of reception active channel modules, the reception active module, the plurality of transmission active channel modules and the transmission active module according to the output signal of the second converting means, and for determining a frequency selection of the second converting means.

6. The antenna system as recited in claim 1, wherein the plurality of reception active channel modules and the plurality of transmission active channel modules are integrated with each other.

7. A method for tracking a satellite signal using an antenna system for satellite communication, the antenna system tracking an elevation electronically and tracking a satellite electronically/mechanically, the method comprising the steps of:

a) setting a satellite signal reception environment by performing an electronic tracking in an elevation direction through an electronic beam steering control and performing a mechanical tracking for driving a rotating element in an azimuth direction; and b) stopping a drive of the rotating element in the azimuth direction, and setting a satellite signal transmission environment by using the satellite signal reception environment, wherein the step b) includes the steps of:

b1) issuing a command for stopping the rotating element for controlling the azimuth direction;

b2) controlling the transmission active channel module to form the transmission electronic beam and powering on a transmission power;

b3) controlling the tracking beam forming module to form a central tracking beam, an upward tracking beam, a downward tracking beam, a left tracking beam and a right tracking beam, and detecting the satellite signal level at each respective position;

b4) if the satellite signal level is smaller than a reference value, powering off the transmission power;

b5) if the satellite signal level is larger than the reference value, comparing the reference value with the satellite signal levels at the positions of the upward tracking beam, the downward tracking beam, the left tracking beam and the right tracking beam, and determining the position of the maximum satellite signal; and b6) updating the position of the reception electronic beam with the position of the maximum satellite signal, and feeding back the corresponding azimuth to thereby make an electronic azimuth steering angle to be "0".

8. The method as recited in claim 7, further comprising the step of c) if failing to catch the satellite signal, breaking a transmission power, performing a mechanical tracking in an azimuth direction during a predetermined time, and performing an electronic tracking in an elevation direction.

9. The method as recited in claim 8, wherein the step c) includes the steps of:

c1) issuing a command for repetitively moving right and left within a predetermined range;

c2) returning to the step a) if a repetitive tracking time is exceeded, and controlling a reception active channel module to form a reception electronic beam to a corresponding angle if the repetitive tracking time is not exceeded;

c3) controlling a tracking beam_forming module to form a central tracking beam, and detecting a satellite signal level of the corresponding position; and c4) if the satellite signal level is larger than a reference value, returning to the step b), and if the satellite signal level is smaller than the reference value, updating the position of the reception electronic beam and repeating the steps c2) and c3).

10. The method as recited in claim 7, wherein the step a) includes the steps of:

a1) issuing a command for causing a drive part of the antenna system to rotate at a constant speed in an azimuth direction;

a2) controlling the reception channel module to form the reception electronic beam;

a3) controlling the tracking beam_forming module to form the central tracking beam, and detecting the satellite signal level of the corresponding position; and a4) if the satellite signal level is smaller than the reference value, updating the position of the reception electronic beam and repeating the steps a2) and a3), and if the satellite signal level is larger than the reference value, returning to the step b).

* * * * *